US006147620A

United States Patent [19]

Remmers et al.

[11] Patent Number: 6,147,620

[45] Date of Patent: Nov. 14, 2000

[54] REMOTE MONITORING OF ELEVATOR CAB LIGHTS

[75] Inventors: Timothy M. Remmers, New Hartford; Barry G. Blackaby, West Simsbury; William A. Wurts, Wethersfield; William C. Rogers, Suffield, all of Conn.

[73] Assignee: Otis Elevator Company, Farmington, Conn.

[21] Appl. No.: 09/281,774

[22] Filed: Mar. 30, 1999

[51] Int. Cl.[7] ..... G08B 5/00

[52] U.S. Cl. ..... 340/815.42; 340/458; 340/642; 73/293; 250/227.14; 250/227.16

[58] Field of Search ..... 340/815.42, 461, 340/458, 931, 642; 73/293; 250/577, 227.14, 227.16, 573, 574, 227.17, 227.18, 205

[56] References Cited

U.S. PATENT DOCUMENTS

| | | | |
|---|---|---|---|
| 4,447,123 | 5/1984 | Page et al. | 350/96.24 |
| 4,561,091 | 12/1985 | Scholl et al. | 370/85 |
| 4,839,527 | 6/1989 | Leitch | 250/573 |
| 4,880,990 | 11/1989 | Rando | 250/577 |
| 5,386,208 | 1/1995 | Coon, III | 340/461 |
| 5,747,793 | 5/1998 | Sundburg et al. | 250/227.14 |
| 5,760,711 | 6/1998 | Burns | 340/962 |

*Primary Examiner*—Edward Lefkowitz
*Assistant Examiner*—Davetta W. Goins

[57] ABSTRACT

To sense the level of light in the passenger compartment 7 of an elevator cab 8, light at the proximal end of an optical fiber 4 is monitored by an optical detector 25 feeding a variable voltage divider 18, which allows setting a trip point at a desired level of light within the passenger compartment, thereby providing a signal indicating whether the light is adequate or not to a remote elevator monitoring apparatus 23. The trip point may be selected on installation by adjusting a potentiometer while watching an optical indication 17 of reaching the trip point, or it may be determined by software routines.

9 Claims, 2 Drawing Sheets

REMOTE MONITORING OF ELEVATOR CAB LIGHTS

TECHNICAL FIELD

This invention relates to monitoring elevator cab lighting by means of an optical fiber and an optical detector with a variable threshold.

BACKGROUND ART

Elevator codes established by regulatory agencies in a number of countries require that elevator service includes monitoring whether the elevator cab lights are functioning or not. Heretofore, lighting status has been monitored by intercepting the wiring of the light power supply, and monitoring the current in the light circuits. However, the current sensor is expensive; the installation time is excessive because the circuit employs high voltage so that the wiring and sensor must be in voltage-protective housings; and failure modes of some lights, such as fluorescent lights, cannot be detected accurately by sensing the current. Furthermore, some elevators power the cab fan from the light circuit; this makes it difficult to distinguish fan on/off variations from bulb failure variations. In cabs with the fan always on, bulb current is a lesser part of the total, and detecting partial lighting failure is difficult.

DISCLOSURE OF INVENTION

Objects of the invention include monitoring the light in an elevator cab in a manner which is low cost, easy to install, resistive to vandalism, useable with a wide variety of monitoring systems, useable with different cabs, different lighting, and different failure modes of lighting.

According to the present invention, a small diameter optical fiber is inserted through a small penetration into the field of light within an elevator cab so that the tip of the fiber is responsive to the light within the cab, the level of light being monitored to determine whether it is above or below an acceptable threshold of light, monitored by a remote elevator monitoring system. When the lights are all disposed above a translucent grid above the passenger compartment, the fiber may be inserted into that part of the cab above the grid. When the bulbs extend directly into the passenger compartment, or are recessed, the fiber may be inserted into the passenger compartment. Similarly, if all of the bulbs are within a light box having translucent portals, the fiber may be inserted into the light box. In accordance further with the invention, light in the fiber may be sensed with a photodiode detector, of the type typically utilized in a data communications network, which promotes miniaturization and low cost. In further accord with the invention, the electrical output of the optical detector is monitored by a voltage comparator having an adjustable threshold, which compensates for variations in sensitivity of the photodiode detectors, as well as adjusting for differing nominal ambient light conditions in a wide variety of different elevators. In still further accord with the present invention, a human perceptible response, such as a light emitting diode (LED), is used by the installer to determine when the switching point is reached for a fully illuminated cab. The installer can then adjust the setting to ensure sensing light of lesser magnitude which is deemed to be adequate, and not requiring immediate service.

Alternatively, the light level may be monitored directly in a data processor, and the normal and failure levels may be established and detected by software routines in the processor.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
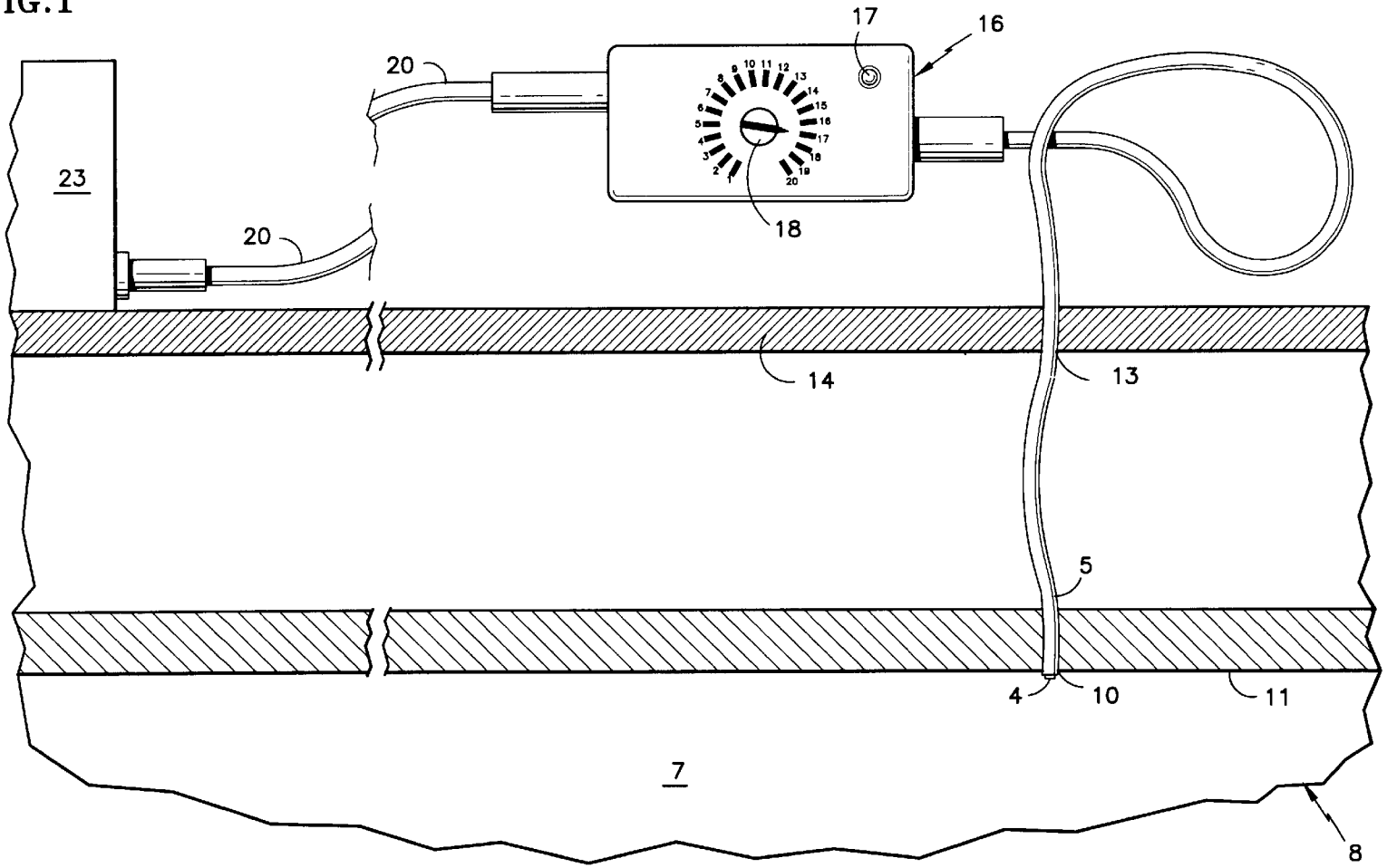
FIG. 1 is a partially sectioned, partially broken away side elevation view of the invention installed at the top of an elevator cab

Referring to FIG. 1, the distal tip of an optical fiber 4 surrounded by a protective sheath 5 extends unobtrusively into the passenger compartment 7 of an elevator cab 8 through a hole 10 in a translucent grill or grid, or other false ceiling 11 of the passenger compartment 7. The sheathed optical fiber 4 also extends through a hole 13 in the canopy or roof 14 of the elevator 8. The sheathed optical fiber is fed into a circuit 16 which includes an indicator, such as an LED 17, and an adjusting means, such as a potentiometer 18, to provide signals over a cable 20 to a remote elevator monitoring (REM) input unit 23.

Figure 2:
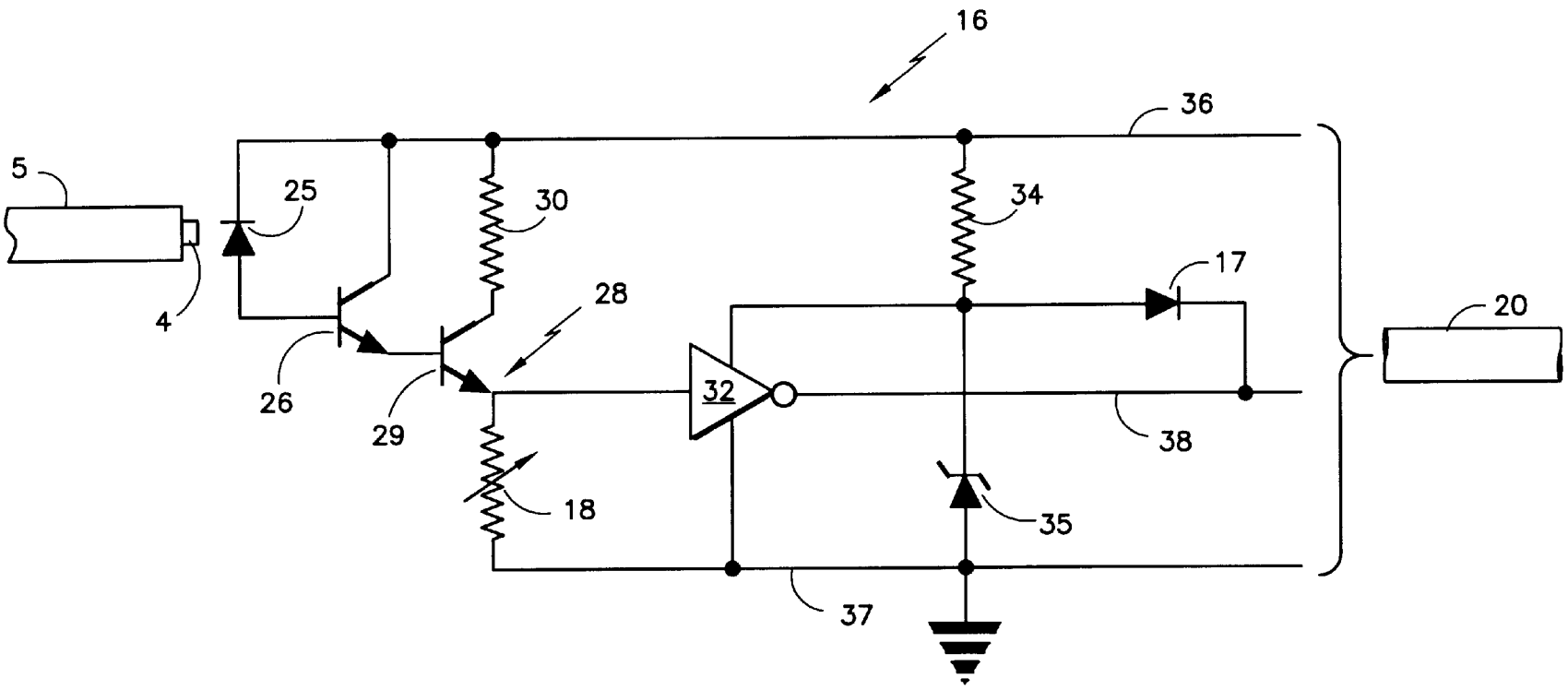
FIG. 2 is a schematic diagram of an exemplary circuit for practicing the invention.

Referring to FIG. 2, the proximal tip of the optical fiber 4 is disposed in the response field of a photodiode 25, the output of which is amplified in a transistor 26 and applied to a voltage comparator 28, consisting of a transistor 29, a fixed resistor 30, the potentiometer 18, and a logic gate 32. A resistor 34 and a Zener diode 35 connected between a suitable operating potential such as +9VDC on a line 36, which is supplied from the REM 23 input over the cable 20, and ground 37, provide a low cost power supply for the logic gate 32. The potentiometer 18 is adjusted so that when there is adequate light within the passenger compartment 7, a trip signal on the line 38 is low, and when the light becomes inadequate, the trip signal on the line 38 is high.

During installation, after the tip of the sheathed optical fiber 4 is installed in the passenger compartment 7, with normal, desired lighting therein, the installer may adjust the potentiometer 18 until the LED 17 is illuminated. This indicates the trip point for the present amount of light in the passenger compartment 7. Adjustment for this trip point facilitates use of a photodiode as the detector to compensate for differences in photodetector sensitivity, which is an uncontrolled parameter. The invention also allows the same light level sensor to be utilized on a wide variety of elevators have significantly different levels of lighting, and different lighting failure modes. In adjusting the circuit 16, the installer may find the trip point for a correctly lit passenger compartment, and then adjust the potentiometer 18 to three-quarters, two-thirds, or some other fraction of that setting as may be determined to be an indication of adequate lighting, below which the lighting is inadequate. On the other hand, the lighting could be purposely subdued (such as by removing bulbs) to a point where it is barely adequate, and the trip point could be set by adjusting the potentiometer 18 for an indication by the LED 17 with that barely-adequate amount of lighting in the passenger compartment 7.

The remote elevator monitoring input 23 may be part of the system shown in U.S. Pat. No. 4,703,325, particularly that designated as a slave unit 20 in FIG. 2 thereof. The invention, however, may be used with other systems, such as those shown in U.S. Pat. Nos. 4,568,909 and 4,622,538, or any other suitable monitoring system.

The photodetector 25 may be an SFH 250V, having a beveled edge on the cathode. The transistors 26, 29 may be 2N2222; the logic gate 32 may be a portion of an HC24; and the Zener diode may be an LM4040CIZ-5. The LED may be an HP HLMP 1700. The optical fiber may be an FRPE1000, having a diameter of 2.0 millimeters (0.087 inches) with its distal tip in the passenger compartment 7 fully rounded so as to provide a collection lens. The sleeve 5 may comprise shrink tubing which has not been heated, or any other suitable protective sheath. In practice, the circuit 16 may be safely lodged in a wiring trough on the top of the elevator.

In FIG. 1, the sheath 5 is seen penetrating the false ceiling 11; however, if desired in any embodiment, the sheath 5 could be kept from passing all the way through the false ceiling 11, and only the optical fiber extend the final distance therethrough into the passenger compartment, thereby to make the invention less visible from within the passenger compartment. The invention may, however, be practiced by inserting the distal end of the optical fiber into a light field within the cab other than the passenger compartment, such as a light box or the space above a translucent grid or other false ceiling, when appropriate. The invention may be practiced with fibers of other types or sizes and with components differing from those described hereinbefore. The invention may be used without the logic gate 32; potentiometer 18 and LED 17, by feeding the amplified output of the detector 25 directly over the cable 20 to a data processor, utilizing software routines to determine, and thereafter detect, normal and failure levels of light and provide a corresponding trip signal; or, the detector 25 may be disposed in the REM input 23, and the optical fiber 4 may be fed directly into the REM input 23.

All of the aforementioned patents are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for monitoring the level of light in an elevator cab, comprising:

an elevator cab having light fixtures for illuminating a passenger usage portion of said cab;

an optical fiber having a distal end extending into a field of light provided by said light fixtures within said cab;

an optical detector disposed adjacent a proximal end of said optical fiber for providing a light level signal indicative of the level of light in said cab; and level responsive means responsive to said light level signal for providing a trip signal indicative of whether the level of light in said passenger compartment is above a threshold level, or not.

2. Apparatus according to claim 1 wherein said distal end is rounded.

3. Apparatus according to claim 1 wherein said optical detector is a photodiode.

4. Apparatus according to claim 1 wherein:

said level sensing means comprises circuitry disposed on said elevator and further comprises:

an indicator for providing a manifestation of the respective presence or absence of said trip signal; and operator controlled means for adjusting said circuitry to vary said threshold level of light required to provide said trip signal.

5. Apparatus according to claim 4 further comprising:

a remote elevator monitoring apparatus; and wherein said trip signal is applied to said remote elevator monitoring apparatus.

6. Apparatus according to claim 4 wherein said indicator is visual.

7. Apparatus according to claim 6 wherein said indicator is an LED.

8. Apparatus according to claim 1 wherein said level responsive means comprises a data processor, and said trip signal is provided by software routines performed therein.

9. Apparatus according to claim 8 wherein said data processor is within remote elevator monitoring apparatus.

* * * * *